United States Patent [19]

Chiodini

[11] 4,004,116

[45] Jan. 18, 1977

[54] PNEUMATIC CYLINDER FOR CONTROLLING ELECTRICAL SWITCH OPERATION

[75] Inventor: Fernando Chiodini, Brooklyn, N.Y.

[73] Assignee: Fenco Corporation, Newark, N.J.

[22] Filed: Apr. 9, 1975

[21] Appl. No.: 566,437

[52] U.S. Cl. ..... 200/82 R; 200/81 R; 91/356

[51] Int. Cl.[2] ..... H01H 35/38

[58] Field of Search ..... 200/82 R, 81 R, 81.9 R; 91/2, 355, 356; 60/380, 409

[56] References Cited

UNITED STATES PATENTS

| | | | |
|---|---|---|---|
| 2,392,471 | 1/1946 | Fox | 200/82 R |
| 2,644,303 | 7/1953 | Rohrscheib | 200/82 R |
| 2,735,405 | 2/1956 | Hipple | 91/356 |
| 3,289,515 | 12/1966 | Chiesa | 91/356 |

*Primary Examiner*—Gerald P. Tolin
*Attorney, Agent, or Firm*—Edward F. Levy

[57] ABSTRACT

A pneumatic switch control has a by-pass air line connected between the air inlet line of a pneumatic cylinder and an air operator which actuates an electrical switch. Back pressure, created in the pneumatic cylinder, is fed to the air operator while the piston in the pneumatic cylinder is moving but the back pressure is reduced to zero when the piston stops, thus actuating the electrical switch.

7 Claims, 5 Drawing Figures

PNEUMATIC CYLINDER FOR CONTROLLING ELECTRICAL SWITCH OPERATION

The present invention relates to control systems operated by pneumatic cylinders and in particular to a pneumatic switch control having a by-pass air line connected between a pneumatic cylinder and an air operator.

The prior art contains examples of devices for producing a signal or an operative pulse in response to the arrival of a piston at the end of its working stroke. Many of these devices include mechanically actuated electrical switches which are operated by stops carried by portions of the piston or the piston rod. In general, these devices are relatively complex, subject to wear and misadjustment, and often tending to malfunction due to the accumulation of dirt particles or other use related problems, leading to a lowering of the overall system reliability.

The present invention overcomes the problems of the prior art by providing a pneumatic switch control in which a by-pass air line is connected between a pneumatic cylinder and an air operator which actuates an electrical switch. The feature of this system is that back pressure, which is created within the pneumatic cylinder by the piston travel, is fed to the air operator while the piston is moving but the back pressure is reduced to zero when the piston stops, thus actuating the electrical switch.

It is an object of the present invention to provide a pneumatic switch control which operates an electrical switch responsive to a piston in a pneumatic cylinder completing its travel.

Another object of the present invention is to provide a pneumatic switch control adapted for the control of the sequence of operations of an automatic metal casting machine.

A further object of the invention is the provision of a pneumatic switch control of the character described, which utilizes existing machine structure, is economical in manufacture and use, and is effective for precise control of one or a sequence of operations in response to the travel of a piston in a cylinder.

In accordance with the invention, there is provided a pneumatic switch control comprising a pneumatic cylinder having a hollow cylinder body, a piston rod extending from the piston to the outside of the cylinder body, an air inlet line communicating with one end of the cylinder body, a by-pass air line communicating with the air inlet line, and pressure actuated switch means connected to said by-pass air line. When air is delivered to the air inlet line for movement of the piston in one direction, the pressure-actuated switch means receives air pressure through the by-pass air line. When the piston moves in the reverse direction, it creates a back pressure in the air inlet line and in the by-pass air line so that air pressure on the switch means is retained. When the piston completes its travel in the reverse direction, the back pressure is reduced to zero, so that the switch is actuated.

Additional objects and advantages of the invention will become apparent during the course of the following specification, when taken in connection with the accompanying drawings in which.

Figure 1:
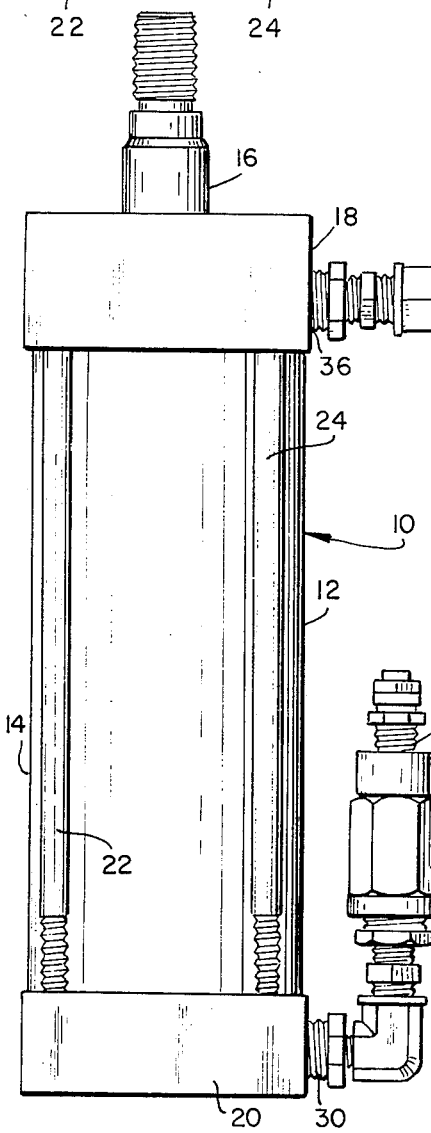
FIG. 1 is a side elevational view of a pneumatic switch control in accordance with the present invention.

Referring in detail to the drawing, there is shown in FIG. 1 a preferred embodiment of a pneumatic switch control 10 made in accordance with the present invention. The pneumatic switch control 10 includes a conventional double acting pneumatic cylinder 12 having a cylinder body 14 within which a piston (not shown) slides in the usual reciprocating movement between the ends of the cylinder. The piston is connected to a piston rod 16 which extends to the outside of the cylinder body 14 and is connected to a movable portion of a machine or the like, to physically drive the same in opposite directions. The cylinder body 14 is held between an upper end cap 18 and a lower end cap 20 by four tie rods 22, 24, 26 and 28. The lower end cap 20 has a lower inlet port 30 which is connected to a lower air inlet line 32 by a coupling 34. The upper end cap 18 has an upper inlet port 36 which is connected to an upper air inlet line 38 by a tee 40. An air by-pass line 42 leads from the tee 40 to a pressure actuated electric switch 44. The switch 44 has internal spring means which bias it to a normal position, for example to a normally-closed position. The switch 44 includes an air operator 46 and an electric switch portion 48 which is operated by pressure exerted by the air operator 46, to actuate the switch from its normal position. The air operator 46 is controlled by air pressure in the by-pass line 42.

In operation, when air under pressure is fed through the upper air inlet line 38 to drive the piston to its lower piston in the cylinder body 12, the pressurized air is also directed through the by-pass line 42 to the pressure actuated switch 44, thus moving the switch from its normally-closed position to an open position. The switch remains in this open position during the entire down-stroke of the piston. At the end of the piston down-stroke, the feed of air to the upper inlet line 38 is discontinued, and air is fed to the lower air inlet line 32 to drive the piston upwardly, and during this upstroke movement, the piston compresses the air in the upper portion of the cylinder body 12 to create a back pressure in the upper air inlet line 38 and in the connected by-pass line 42, which back pressure maintains the switch 44 in open position during the upward stroke of the piston. When the piston reaches the end of its upward stroke, the air pressure in the by-pass line 42 dissipates through the upper air inlet line 38 and is reduced to zero, thus releasing pressure on the switch 44 and permitting it to be biased to its normally-closed position. In effect, therefore, the switch 44 is actuated to commence an operation or a sequence of operations in response to the piston rod 16 reaching an operative position.

Figure 5:
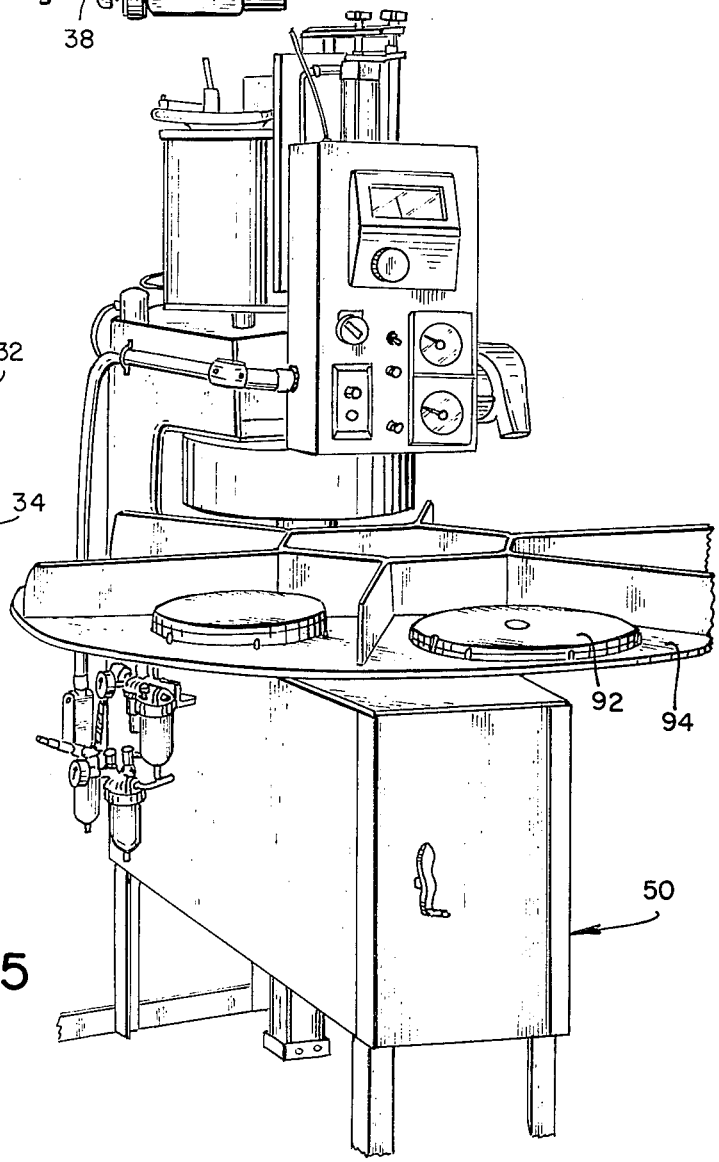
FIG. 5 is an overall perspective view of the casting machine of FIG. 3.

For purposes of illustration, the pneumatic switch control 10 according to the present invention is shown incorporated in an automatic metal casting machine 50 of the type shown in FIG. 5. The automatic metal casting machine 50 illustrated is of the well-known revolving turntable type, in which a series of rotatably-mounted metal molds are successively moved to a work station in which the mold sections are closed and clamped together, a charge of molten metal is fed into the mold cavities, the mold is rapidly rotated to perform the molding operation, and clamping pressure on the mold sections is then released and the mold moved away from the work station to enable the molded articles to be removed. The switch control 10 incorporated in this machine effects a time sequence of machine operation in response to the opening and closing of the respective molds which is performed by the pneumatic cylinder 10. The automatic metal casting machine 50 includes two pneumatic switch controls 52 and 54, according to the present invention; the first pneumatic switch control 52 operates on a constant stroke and the second pneumatic switch control 54 operates on a variable stroke in order to accommodate molds having different heights.

Figure 2:
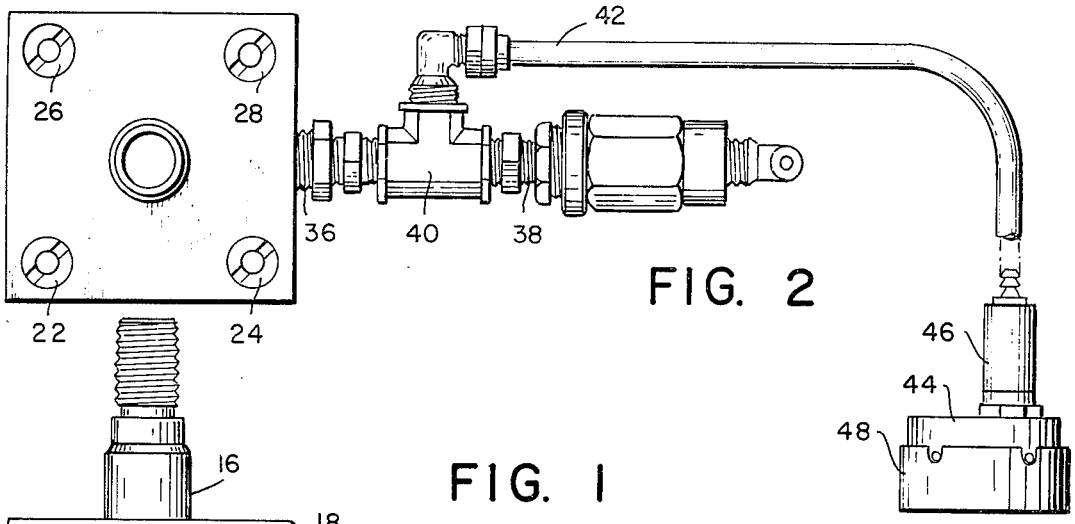
FIG. 2 is a top plan view of the pneumatic switch control according to FIG. 1.
Figure 3:
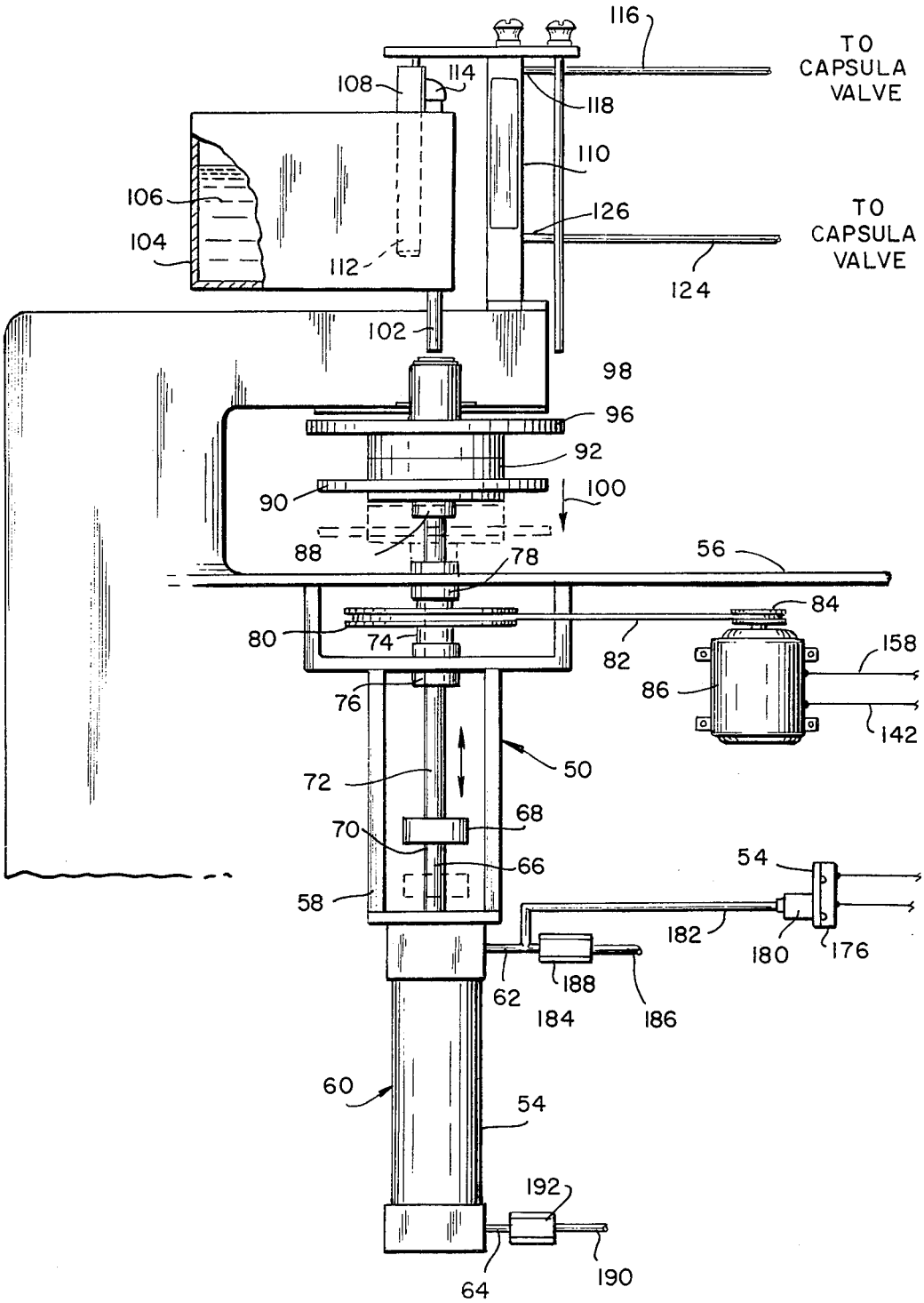
FIG. 3 is a schematic elevational view of a portion of an automatic metal casting machine incorporating the pneumatic switch control of FIG. 1.

As shown in FIG. 3, the automatic metal casting machine 50 has a base 56 on which is mounted a support frame 58 holding a clamping cylinder 60. The clamp cylinder 60 is double acting and is identical to the cylinder 10 shown in FIGS. 1 and 2. The clamp cylinder 60 receives air alternately through an upper port 62 and through a lower port 64. A piston rod 66 extends in an upward direction from the clamp cylinder 60 and has a thrust coupling 68 on its upper end 70. The thrust coupling 68 is attached to a shaft 72 which slides within and is keyed to a drive shaft 74 mounted in bearings 76 and 78 on the support frame 58. A pulley 80 is mounted on the drive shaft 74 and is connected by a drive belt 82 to the drive pulley 84 of an electric motor 86. The upper end 88 of the shaft 72 is attached to a lower clamp plate 90 supporting a conventional hollow rubber centrifugal mold 92. Upward movement of the piston rod 66 to the elevated position shown in solid lines in FIG. 3 causes the lower clamp plate 90 to lift the hollow mold 92 out of the rotatable conveyor table 94, shown in FIG. 5 and to clamp the hollow mold 92 against an upper clamp plate 96 which is mounted on a hollow thrust bearing 98. Retraction of the piston rod 66 moves the lower clamp plate 90 in a downward direction shown by the arrow 100 to the position shown in broken lines in FIG. 3, thus bringing the hollow mold 92 back on to the rotatable conveyor table 94.

The hollow thrust bearing 98 is in registry with a supply tube 102 leading from the inside of a supply tank or reservoir 104 containing a supply of molten metal 106. A supply ladle 108 is attached to a pot cylinder 110 and depends into the supply of molten metal 106. Extension of the piston rod of the pot cylinder 110 lifts the lower portion 112 of the supply ladle 108 into registry with an opening 114 in the supply tube 102 thus pouring a quantity of molten metal 106 through the supply tube 102 into the interior of hollow mold 92.

Figure 4:
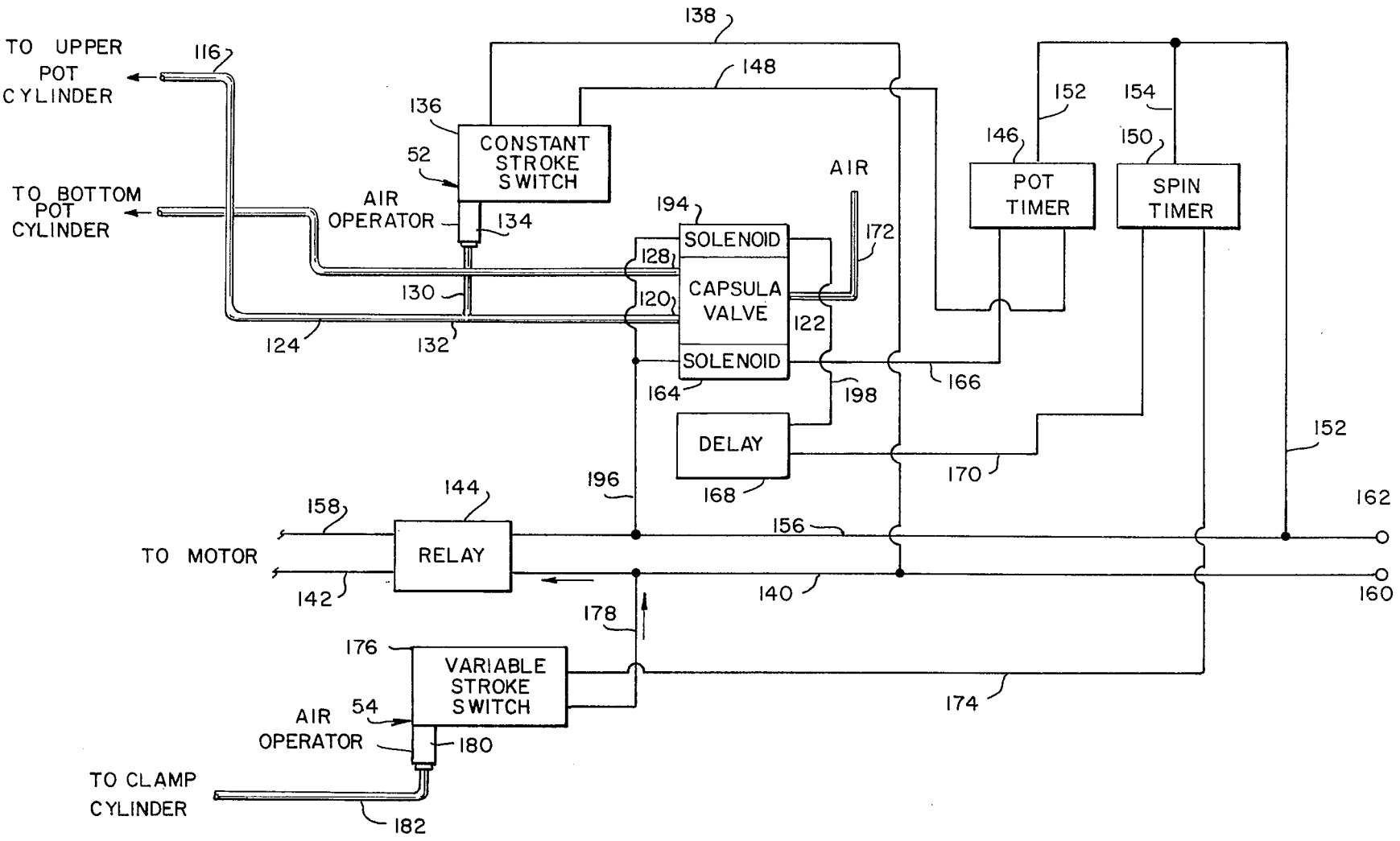
FIG. 4 is a schematic diagram of the circuit connections of the casting machine shown in FIG. 3.

An air line 116 leads from the upper port 118 of the pot cylinder 110 to the lower inlet port 120 of a capsula valve 112 (FIG. 4) and an air line 124 leads from the lower port 126 of the pot cylinder 110 to the upper port 128 of the capsula valve 122. As shown in FIG. 4, a by-pass air line 130 leads from an intermediate portion 132 of the air line 124 to an air operator 134 which forms part of the constant stroke pneumatic switch control 52.

The constant stroke pneumatic switch control 52 includes a normally closed electric switch 136 which is connected to the electric pot timer 146 via the lead 148. The pot timer 146 connected to the spin timer 150 via leads 152 and 154 and to the relay 144 via the leads 152 and 156, and to the motor 86 via the lead 158. The leads 142 and 158 are connected to a source of electric power via terminals 160 and 162, for energization of the electric motor 86. The pot timer 146 is also connected to the lower solenoid 164 of the capsula valve 122 via lead 166, and the spin timer 150 is connected to a time delay 168 via the lead 170. The capsula valve 122 receives a supply of air through an air line 172. Then spin timer 150 is connected to the variable stroke pneumatic switch control 54 via the lead 174, and the normally-closed electric switch 176 of the variable stroke pneumatic switch control 54 is connected to the relay 144 via lead 178.

As shown in FIG. 3, normally-closed electric switch 176 is operated by an air operator 180 which is fed by a by-pass line 182 connected to an intermediate portion 184 of the air line 186 leading to the upper port 62 of the clamp cylinder 60. The air line 186 includes a flow control 188, and an air line 190, leading to the lower port 64 of the clamp cylinder 60, includes a flow control 192.

The relay 144 is connected to the lower and upper solenoids 164, 194 of the capsula valve 122 via the lead 196, and the upper solenoid 194 is connected to the time delay 168 via the lead 198.

The sequence of operation of the automatic metal casting machine 50 will now be explained with reference FIGS. 3 and 4. When the machine conveyor or turntable is rotated to bring a selected empty mold 92 to the work station, the clamp cylinder 60 receives air through the lower air line 190 and the flow control 192, thus starting the contained piston on its up-stroke and moving the piston rod 66 and the lower clamp plate 90 upwardly. The lower clamp plate 90 lifts the hollow mold 92 out of the rotatable conveyor table 94 and clamps the mold against the upper clamp plate 96. As the piston within the clamp cylinder 60 rises, air is compressed and forced out of the upper cylinder port 62, controlled by the flow control 188, and passes through the by-pass line 182 to maintain pressure on the air operator 180 which holds the normally-closed electric switch 176 in open position. When the mold 92 is firmly clamped between the upper and lower clamp plates 90 and 96, the upward stroke of the piston within the clamp cylinder 60 terminates and the air pressure within the upper cylinder port 62 and within the by-pass line 182 is reduced to zero and pressure on the air operator 180 is relieved, causing the normally-closed electric switch 176 to close and send an electrical impulse to the relay 144. Energization of the relay 144 starts the motor 86 which drives the pulley 80 and spins the mold 92. The closing of the elextric switch 176 also energizes the upper solenoid 194 of the capsula valve 122, and through the solenoid 194 simultaneously starts the time delay 168. The energization of the upper solenoid 194 shifts a spool within the capsula valve 122 to permit air to enter the lower port 126 of the pot cylinder 110, thereby raising the supply ladle 108 which is filled with molten metal 106.

As the piston within the pot cylinder 110 travels upward, it compresses the air in the upper portion of the pot cylinder 110, so that air under pressure flows through the upper air line 116 and is supplied through the by-pass line 130 to the air operator 134, which holds the normally-closed constant stroke switch 136 in open position. When the piston within the pot cylinder 110 completes its up-stroke, an opening in the lower portion 112 of the supply ladle 108 is in registry with the opening 114 in the supply tube 102 and a stream of molten metal flows from the supply ladle 108, through the supply tube 102, and into the hollow mold 92. At the time that the piston within the pot cylinder 110 completes its upward travel, the pressure in the by-pass air line 130 and air operator 134 drops to zero, and the normally-closed electric switch 136 moves to closed position, thereby sending a signal to the pot timer 146 which was preset to control the amount of metal poured. When the pot timer 146 completes its timing cycle, it sends a signal to the lower solenoid 164 of the capsula valve 122, and the solenoid 164 operates to shift a spool within said capsula valve in such a manner as to feed air through the upper air line 116 to the upper port of pot cylinder 110, to move the piston within the pot cylinder downward, thus stopping the pour of molten metal into the mold. Simultaneously, a signal is also sent from the pot timer 146 to the spin timer 150, which starts the latter. The air pressure which drives the piston within the pot cylinder 110 on its downstroke, also acts on the air operator 134, thus re-opening the normally-closed electric switch 136.

When the spin timer 150 has approximately 3 seconds remaining in its timing cycle, it de-energizes the relay 144 which stops the motor 86 and terminates the spinning of the mold 92. When the spin timer 150 reaches the end of its timing cycle, a signal is sent to a valve (not shown) which sends air to the top of the clamp cylinder 60 via air line 186, thereby driving the piston rod 66 downward and returning the hollow mold 92 to the rotatable conveyor table 94. The air pressure in air line 186 is also directed through by-pass line 182 to the air operator 180 which opens the normally-closed electric switch 176, thus preparing the automatic casting machine 50 for the next cycle of operation.

In the above illustration, the pneumatic switch controls 52 and 54 are seen to provide a simple method for accomplishing a switching function which activates successive operations in a series. The application of the pneumatic switch control 10 to the automatic casting machine 50 of FIG. 5 has been shown by way of illustration only, and it understood that the pneumatic switch control 10 may be used in numerous applications whenever pneumatic cylinders are used in reciprocating operations and the control of another operation responsive to the completion of the operative strokes of a pneumatic cylinder is required. In an alternative embodiment, which is not shown, the double acting pneumatic cylinder is replaced by a single acting pneumatic cylinder and the electrical switch is replaced by an air valve. For use is hydraulic circuits, the pneumatic cylinder may be replaced by a hydraulic cylinder and the air operator may be replaced by an operator that is compatible with hydraulic fluid.

While preferred embodiments of the invention have been shown and described herein, it is obvious that numerous additions, changes and omissions may be made in such embodiments without departing from the spirit and scope of the invention.

What is claimed is:

1. A pneumatic switch control comprising a pneumatic cylinder including a hollow cylinder body having a piston slidably disposed therein and a piston rod extending from said piston to the outside of said cylinder body, first drive means for moving said piston in an operative stroke from one end portion of said cylinder body to the opposite end portion thereof, second drive means for moving said piston in a return stroke from said opposite end portion of the cylinder body to said one end portion thereof, said second drive means comprising an air inlet line communicating with said one end portion of said cylinder body for supplying air under pressure into said one end portion, said switch control also comprising a by-pass air line communicating with said air inlet line, and pressure actuated switch means connected to said by-pass air line, movement of said piston in said operative stroke by said first drive means creating back pressure in said opposite end of said cylinder body with said back pressure being applied through said air inlet line and said by-pass air line to said switch means for deactuating the latter, said pressure actuated switch means also being deactuated by pressure received from air introduced through said air inlet line to move said piston in its return stroke, movement of said piston in said operative stroke by said first drive means creating back pressure in said opposite end of said cylinder body with said back pressure being applied through said air inlet line and said by-pass air line to said switch means for maintaining the latter in deactuated condition, said back pressure acting on said pressure actuated switch means ceasing when said piston reaches the end of its operative stroke and said back pressure dissipates through said air inlet line, thus actuating said pressure actuated switch, whereby said switch is actuated in response to the arrival of said piston at the end of its operative stroke.

2. A pneumatic switch control according to claim 1 in which said first drive means comprises a second air inlet line communicating with said one end portion of said cylinder body.

3. A pneumatic switch control according to claim 2 in which said pressure actuated switch means is adapted to be connected to an electrical circuit adapted to initiate machine operations remote from the operation of said pneumatic cylinder.

4. A pneumatic switch control according to claim 2 in which said pneumatic cylinder comprises a double-acting pneumatic cylinder.

5. A pneumatic switch control according to claim 2 in which said pressure actuated switch means comprises an air operator and an electric switch, said air operator being operatively coupled to said electric switch and being connected to said by-pass air line.

6. A pneumatic switch control according to claim 3 in which said electric switch is a normally-closed switch.

7. A pneumatic switch control according to claim 2 in which said air inlet line includes a flow control.

* * * * *